US005388829A

United States Patent [19]

Holmes

[11] Patent Number: 5,388,829

[45] Date of Patent: Feb. 14, 1995

[54] REEL MECHANISMS FOR GAMING MACHINES

[75] Inventor: Robert A. Holmes, Surrey, England

[73] Assignee: Starpoint Electronics Limited, Surrey, England

[21] Appl. No.: 204,214

[22] PCT Filed: Sep. 1, 1992

[86] PCT No.: PCT/GB92/01597

§ 371 Date: Feb. 28, 1994

§ 102(e) Date: Feb. 28, 1994

[87] PCT Pub. No.: WO93/05484

PCT Pub. Date: Mar. 18, 1993

[30] Foreign Application Priority Data

Sep. 2, 1991 [GB] United Kingdom ..... 9118733
Dec. 4, 1991 [GB] United Kingdom ..... 9125844

[51] Int. Cl.[6] ..... G07F 17/34
[52] U.S. Cl. ..... 273/143 R
[58] Field of Search ..... 273/143 R, 138 A

[56] References Cited

U.S. PATENT DOCUMENTS 4,912,389 3/1990 Eguchi ..... 273/143 R
5,152,529 10/1992 Okada ..... 273/143 R

FOREIGN PATENT DOCUMENTS 0081981 6/1983 European Pat. Off. ..... 273/143 R
0095319 11/1983 European Pat. Off. ..... 273/143 R
2156565 10/1985 United Kingdom ..... 273/143 R
2160345 12/1985 United Kingdom ..... 273/143 R
2182478 5/1987 United Kingdom ..... 273/143 R

*Primary Examiner*—Benjamin H. Layno
*Attorney, Agent, or Firm*—Sughrue, Mion, Zinn, Macpeak & Seas

[57] ABSTRACT

A reel mechanism for a gaming machine comprising a support which carries a motor, a reel, a lamp and an optical device. The motor carries the reel and the reel support. The reel includes a reel strip provided with symbols to be illuminated by the lamp. The reel support is provided with a tab to be sensed by the optical device. The lamp is adjustably movable relatively to the support; characterized in that the optical device, and preferably the motor, are also adjustably movable in unison with the lamp relative to the support.

10 Claims, 4 Drawing Sheets

REEL MECHANISMS FOR GAMING MACHINES

The present invention relates to the construction of reel mechanisms for gaming machines which are sometimes referred to as fruit machines or amusement machines.

BACKGROUND OF THE INVENTION

It is well known that gaming machines can include adjacent reel mechanisms each comprising a reel marked around its circumferential surface with symbols such as fruit. In operation, the reels are caused to spin about a common axis by pulling a handle or pressing a button. When the reels come to a standstill, the positions of the symbols on the different reels in relation to one or more predetermined lines decide whether or not a player has won.

Each predetermined line may take the form of a row of windows or other openings in the gaming machine.

Each reel is typically formed from a reel strip and a reel support.

The reel strip is usually formed of a plastics material. Typically it is a translucent plastics material with a predetermined number of the symbols printed or otherwise provided thereon. The reel strip is usually illuminated from behind, with a respective lamp being provided for the or each of the openings associated with the reel strip.

For each of the reel strips, there may be an array of for example three of the lamps associated with opening(s) through which an adjacent three of the symbols can be seen.

The reel support is usually also formed of a plastics material. It may include a pair of co-axial rings joined by circumferentially spaced cross-pieces to define a skeletal drum around which the reel strip is to be wrapped. Alternatively, it may include a single ring formed with an annular slot into which an edge of the reel strip is to be inserted. The or one of the rings may have several spokes extending radially inwardly therefrom to a central drive connector for releasable connection with a rotatable spindle of a motor such as a stepper motor.

The motor may be adjustably carried by a support which is to be mounted on support structure within the gaming machine, the support also being used to carry an optical device which is to be connected to electrical circuitry within the gaming machine.

Each of the optical devices may include an emitter and an associated sensor located in positions such that a part of the associated reel passes therebetween upon each revolution of the reel. For example, a projecting part of a reel in the form of a tab may be used to break a beam of light or infra-red radiation directed from an emitter to a sensor. The breaking of the beam may be detected by the electrical circuitry to provide information as to the angular position of the reel relatively to the optical device and/or the number of times that the reel has been spun.

It is important operationally that when the tab is positioned centrally between the emitter and the sensor of the optical device, or at a known position relatively thereto, one of the symbols on the reel strip is positioned between a lamp and an opening associated therewith, whereby said symbol is both fully and clearly visible.

Hitherto, in order to achieve this relationship it has been necessary to make several checks and adjust as appropriate.

For each of the reel strips, the lamp(s) need to be in the correct position relatively to the associated opening(s). The relationship of the opening(s) to the support structure is known for any given gaming machine and is commonly different for different gaming machines. It is thus necessary to be able to adjust the positions of the lamp(s) and this capability is usually provided by mounting the lamp(s) for angular adjustment on the associated support. There can be a releasable pin-and-slot type connection, between a housing for the lamp(s) and the support, enabling the lamp(s) to be moved relatively to the associated opening(s). There can also be calibrations on the support to facilitate setting of the lamp(s) in a predetermined position correct for the given gaming machine.

It is also necessary for the symbol(s) to be in the correct position relatively to the associated tab. As the relationship of the opening(s) to the support structure is commonly different for different gaming machines, and the optical device has always hitherto been in a fixed position on the support, it has been necessary to be able to adjust the position of the tab relatively to the symbol(s). This capability has usually been provided by mounting the tab for angular adjustment around the periphery of the or one of the rings forming part of the reel support. When the symbol(s) are in the correct position relatively to the associated opening(s), the angular position of the tab on the reel support is adjusted to locate the tab centrally between the emitter and the sensor of the fixed optical device, or less commonly at a known position relatively thereto.

In practice, because the reel may not be in a position determined by the electrical circuitry, it may be necessary after energisation of the motor to adjust the position of the motor relatively to the support, and this is again usually achieved by a releasable pin-and-slot type connection, between a housing for the motor and the support.

SUMMARY OF THE INVENTION

An aim of the present invention has been to simplify the above-described adjustment procedures, especially when transferring a reel mechanism from one gaming machine to another gaming machine of different constructional characteristics.

According to the present invention, a reel mechanism comprises a support which carries a motor, a reel, a lamp and an optical device;

the motor carrying the reel, the reel including both a reel strip provided with symbols to be illuminated by the lamp as well as a reel support provided with a tab to be sensed by the optical device, and the lamp being adjustably movable relatively to the support;

characterised in that the optical device is also adjustably movable relatively to the support.

It will be appreciated that in the present invention there is no need to provide for "adjustment" of the position of the tab relatively to the reel strip, even for different gaming machines having different constructional characteristics, because it is merely necessary to provide for predetermined "location" of the tab relatively to the reel strip.

This can be easily achieved in a manner known per se. The reel strip may be provided with identification such as a printed line, perforation or peripheral notch to be aligned with a complementary marking, peg or rib provided on the reel support in a known position relatively to the tab provided on the reel support. As the tab need not be adjustable it can be moulded or fixedly secured to the reel support.

Preferably, the centre line between an emitter and a sensor of the optical device is in radial alignment with the centre line of a filament of the lamp.

Also preferably, the lamp is carried by a lamp housing and the optical device is also carried by the lamp housing to be movable in unison therewith. There may be a snap connection between the optical device and the lamp housing. There may be an array of three of the lamps carried by a common lamp housing formed of a plastics material. The optical device may be of generally conventional construction. It may thus include its own electrical circuitry or alternatively be connectable to electrical circuitry by appropriate releasable or non-releasable connectors.

In a modification, the need to effect realignment of the motor is avoided by arranging for the motor to be adjustably movable relatively to the support in unison with the adjustment of the lamp(s) and the optical device.

In particular, instead of a motor housing being carried by the support, the lamp housing may carry each of the motor, the lamp(s) and the optical device. At a sub-assembly stage in production the motor is powered-up and set in a desired position on the lamp housing and need never be adjusted again. The sub-assembly, including the lamp housing, the motor, the lamp(s) and the optical device, may be clipped onto the support to be angularly adjustable relatively thereto.

BRIEF DESCRIPTION OF THE DRAWINGS

Two reel mechanisms, in accordance with the present invention, will now be described in more detail, by way of example only, with reference to the accompanying drawings, in which.

DETAILED DESCRIPTION OF THE PREFERRED EMBODIMENT

Figure 1:
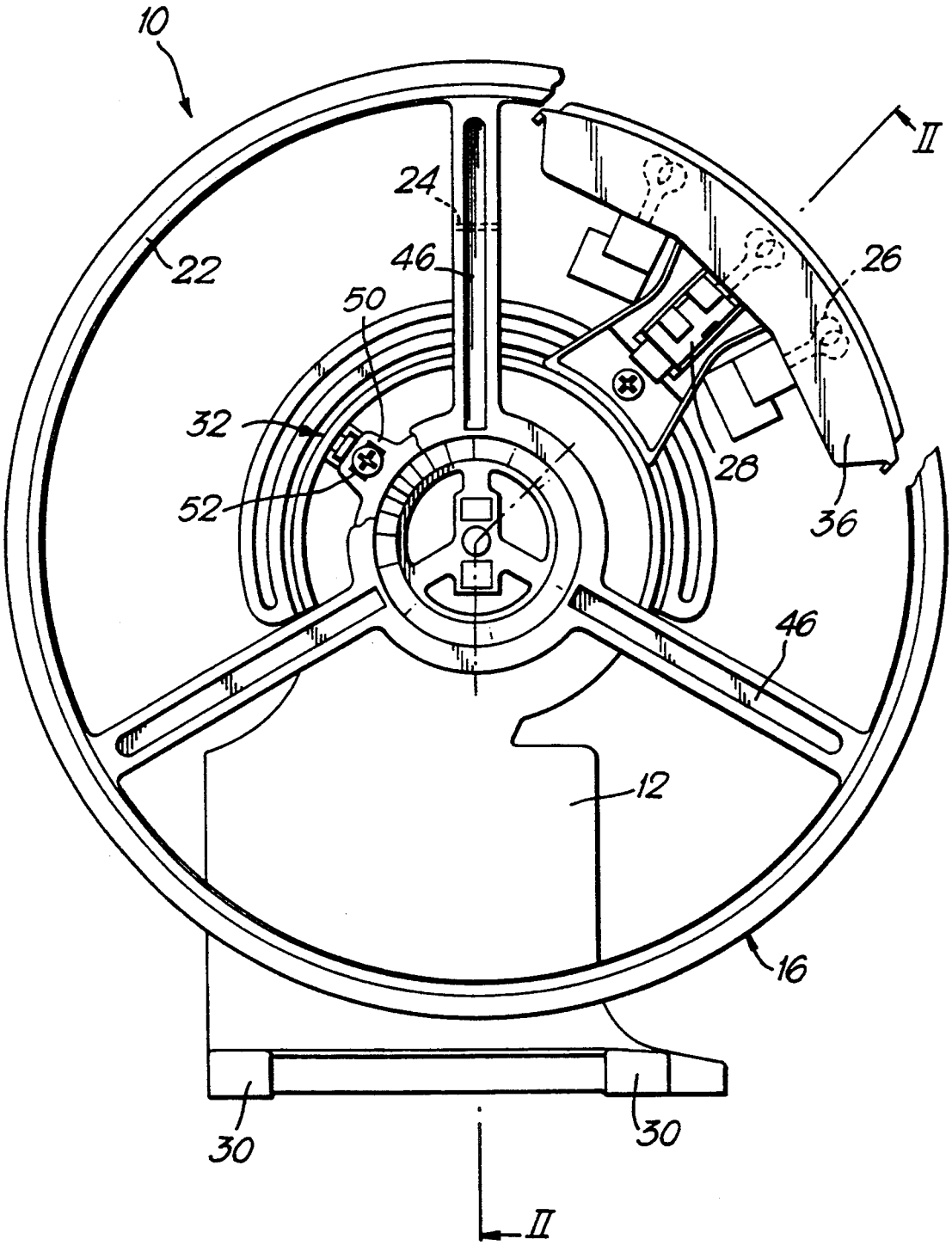
FIG. 1 is a partly fragmented schematic side view of one of the reel mechanisms.
Figure 2:
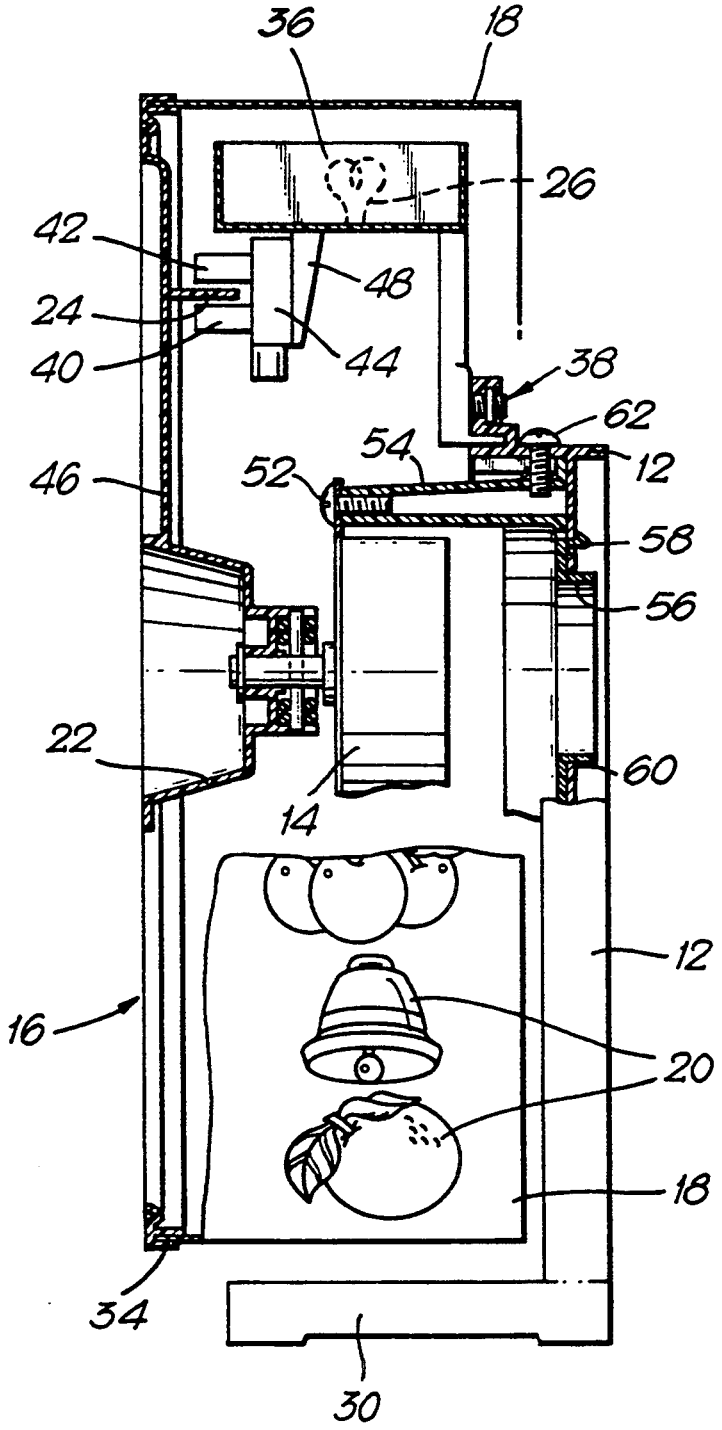
FIG. 2 is a partly fragmented schematic cross-sectional view of the reel mechanism of FIG. 1 taken along the broken line II—II but repositioned such that the tab is located centrally of the optical device.

As shown in FIGS. 1 and 2, a reel mechanism 10 in accordance with the present invention comprises a support 12, a motor 14 carried by the support 12, a reel 16 carried by the motor 14 and including both a reel strip 18 provided with symbols 20 as well as a reel support 22 provided with a tab 24, a lamp 26 adjustably movable relatively to the support 12, and an optical device 28 also adjustably movable relatively to the support 12.

Many of the above-listed components are of generally conventional construction and thus need not be described in detail.

Thus, the support 12 may be a plastics lattice-like frame including a pair of legs 30 to be secured by screws to support structure (not shown) within a gaming machine. The motor 14 may be adjustable angularly relatively to the support 12 by a known pin-and-slot type connection indicated at 32. The reel strip 18, when wrapped into cylindrical shape, may have one edge of its translucent plastics material located within and supported by an annular slot 34 provided by the reel support 22. The angular position of the reel strip 18 in the annular slot 34 may be determined by providing said edge of the reel strip 18 with a notch (not shown) which locates as a pushfit on a rib protruding from the base of the annular slot 34. There may be three of the lamps 26 in a common lamp housing 36 which is angularly adjustable relatively to the support 12 by another pin-and-slot type connection with calibrations indicated at 38. The optical device 28 may include an infra-red emitter 40 and a phototransistor sensor 42 located on a plastics housing 44 which is connectable to electrical circuitry (not shown) or indeed contains its own electrical circuitry.

Particular features of this embodiment of the present invention are:

a) the tab 24 is moulded as a blade on, or otherwise fixedly secured to, one of three spokes 46 of the reel support 22; and b) the optical device 28 is fixedly secured to the common lamp housing 36 for movement in unison therewith.

There may be a snap connection between the housing 44 of the optical device and a bracket 48 extending from the common lamp housing.

When transferring the reel mechanism 10 from one gaming machine to another, in which there is a different relationship (physical separation/orientation) between its support structure and its windows through which the illuminated symbols 20 are visible, it is merely necessary to adjust the position of the common lamp housing 36, thereby at the same time adjusting the position of the optical device 28, and then realign the motor 14 to said adjusted position.

In this embodiment, the motor 14 includes an apertured flange 50 secured by a screw 52 to a motor housing 54 formed of a plastics material with a cylindrical bearing portion 56 and a plurality of spaced-apart resilient clips 58. There may be three of the clips 58 on the motor housing 54 for snap assembly in respective arcuate slots (not shown) in the support 12 when the bearing portion 56 is received in a circular opening 60 in the support 12. The motor housing 54 is engaged by a screw 62 of which only its shank can extend through a circumferentially extending slot in the support 12, with the screw 62 and its associated slot constituting the pin-and-slot type connection indicated at 32.

Figure 3:
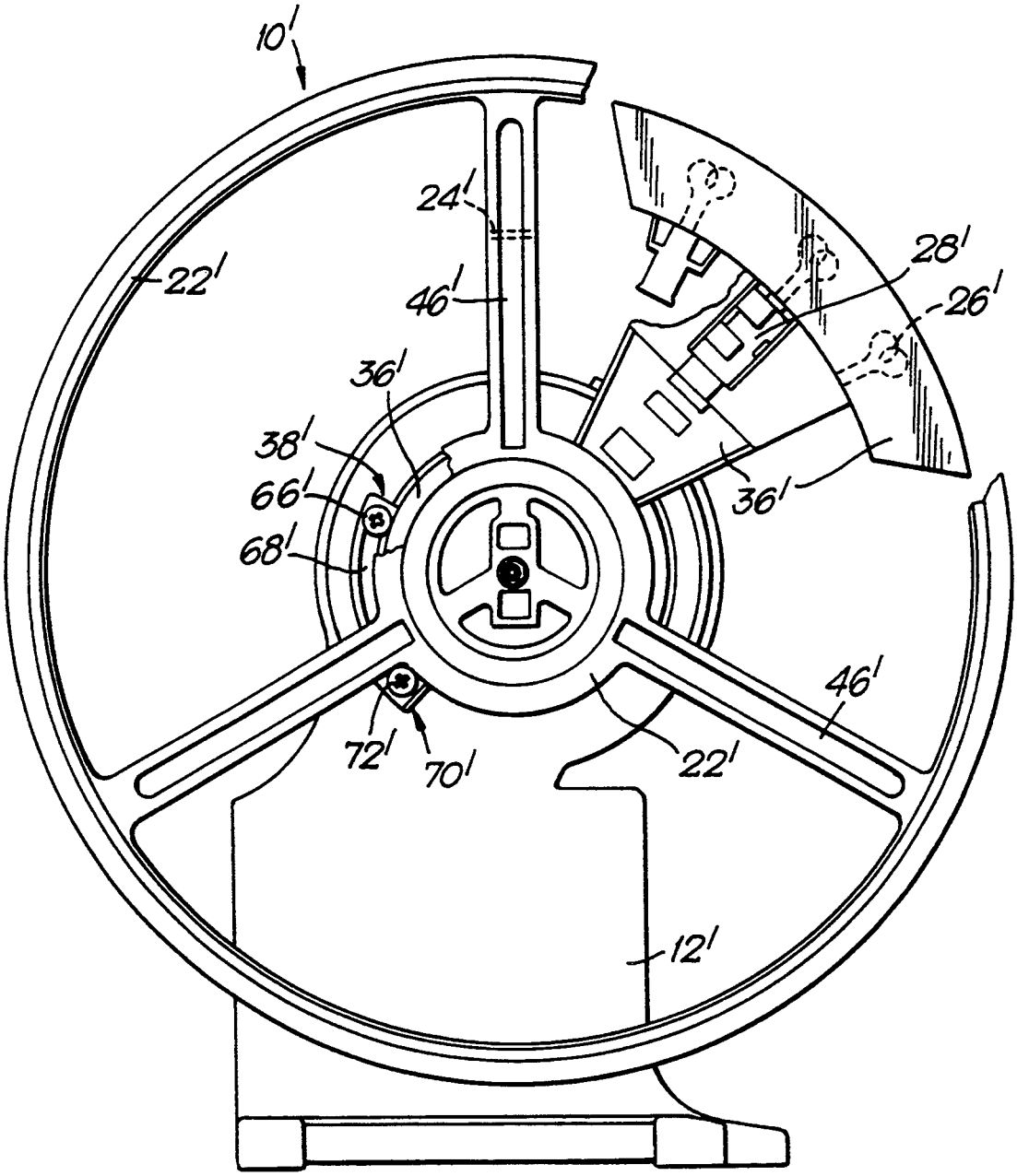
FIGS. 3 and 4 are similar to FIGS. 1 and 2, respectively, but show the other of the reel mechanisms.
Figure 4:
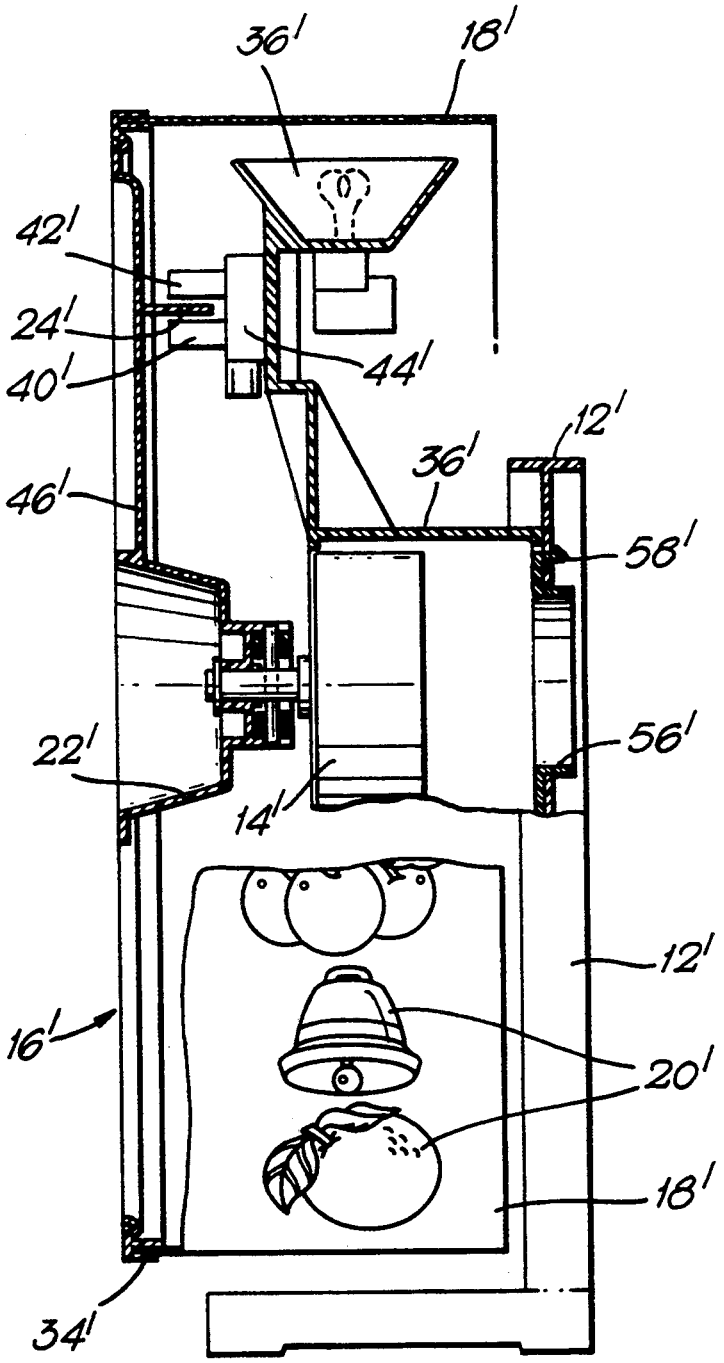

The need to realign the motor is avoided by the embodiment of the present invention shown in FIGS. 3 and 4 in which components similar to those in the embodiment of the present invention shown in FIGS. 1 and 2 have been given similar reference numbers.

It can be seen that the lamp housing 36' carries each of the motor 14', the lamp(s) 26' and the optical device 28'. The motor 14', the lamp(s) 26' and the optical device 28' are thus movable in unison with angular adjustment of the lamp housing 36'. More particularly, the lamp housing 36' is integrally formed with the motor housing to include the bearing portion 56' and the clips 58'. The support 12' is engaged by a screw 66' of which only its shank can extend through a circumferentially extending slot 68' in the lamp housing 36', with the screw 66' and the slot 68' constituting the pin-and-slot type connection with calibrations indicated at 38'.

It should be appreciated that there is another pin-and-slot type connection 70', allowing initial angular adjustment of the motor 14' relatively to the lamp housing 36', the pin-and-slot type connection 70' being constituted by a screw 72' and a circumferentially extending slot in the lamp housing 36', which is partially obscured by one of the spokes 46'.

I claim:

1. A reel mechanism (10; 10') comprising a support (12; 12') which carries a motor (14; 14'), a reel (16; 16'), a lamp (26; 26') and an optical device (28; 28');

the motor carrying the reel, the reel including both a reel strip (18; 18') provided with symbols (20; 20') to be illuminated by the lamp as well as a reel support (22; 22') provided with a tab (24; 24') to be sensed by the optical device, and the lamp being adjustably movable relatively to the support;

characterised in that the optical device is also adjustably movable relatively to the support.

2. A reel mechanism according to claim 1, characterised in that the tab is secured to the reel support without being adjustable relatively thereto.

3. A reel mechanism according to claim 2, characterised in that the tab (24; 24') is integrally moulded in a plastics material on a spoke (46; 46') of the reel support.

4. A reel mechanism according to claim 1, characterised in that the optical device is secured to a lamp housing (36; 36') for adjustment in unison therewith.

5. A reel mechanism according to claim 4, characterised in that the optical device (28; 28') is located in a housing (44; 44') which snap connects with a part of the lamp housing (36; 36') located radially inwardly of the lamp.

6. A reel mechanism according to claim 1, characterised in that the motor (14') is adjustably movable relatively to the support (12') in unison with the adjustment of the lamp (26') and the optical device (28').

7. A reel mechanism according to claim 6, characterised in that there is a pin-and-slot type connection (38') between the support (12') and the lamp housing (36').

8. A reel mechanism according to claim 7, characterised in that there is another pin-and-slot type connection (70') between the motor (14') and the lamp housing (36').

9. A reel mechanism according to claim 1, characterised in that the optical device (28; 28') includes an infrared emitter (40; 40') and a phototransistor sensor (42; 42').

10. A reel mechanism according to claim 1, characterised in that the reel support (22; 22') includes a single ring formed with an annular slot (34; 34') into which an edge of the reel strip (18; 18') is to be inserted.

* * * * *